US006867354B2

(12) United States Patent
Shimooka et al.

(10) Patent No.: US 6,867,354 B2
(45) Date of Patent: Mar. 15, 2005

(54) TREMOLO UNIT FOR ELECTRIC GUITAR

(75) Inventors: Tatsuru Shimooka, Nagoya (JP); Shinjiro Hirayama, Seto (JP)

(73) Assignee: Hoshino Gakki Co. Ltd. (JP)

( * ) Notice: Subject to any disclaimer, the term of this patent is extended or adjusted under 35 U.S.C. 154(b) by 0 days.

(21) Appl. No.: 10/171,442

(22) Filed: Jun. 13, 2002

(65) Prior Publication Data

US 2003/0066407 A1 Apr. 10, 2003

(30) Foreign Application Priority Data

Oct. 5, 2001 (JP) ..... 2001-310743
Feb. 19, 2002 (JP) ..... 2002-042164

(51) Int. Cl.[7] ..... G10D 3/14
(52) U.S. Cl. ..... 84/312 R; 84/313; 84/298; 84/299; 84/307
(58) Field of Search ..... 84/312 R, 313, 84/298, 299, 307

(56) References Cited

U.S. PATENT DOCUMENTS 4,171,661 A 10/1979 Rose ..... 84/313
4,497,236 A * 2/1985 Rose ..... 84/298
4,549,461 A * 10/1985 Rose ..... 84/313
4,724,737 A 2/1988 Fender ..... 84/313
5,083,492 A 1/1992 Gorr ..... 84/313
5,109,745 A * 5/1992 Tomita ..... 84/313
5,672,835 A * 9/1997 Doughty ..... 84/313
5,986,191 A 11/1999 McCabe ..... 84/313

OTHER PUBLICATIONS

Korean Office Action dated Apr. 9, 2004.*

* cited by examiner

*Primary Examiner*—Shih-Yung Hsieh
(74) *Attorney, Agent, or Firm*—Ostrolenk, Faber, Gerb & Soffen, LLP

(57) ABSTRACT

Various kinds of members are located on the body of an electric guitar, and strings are supported by the members at predetermined positions along the longitudinal direction. The strings are adjusted by a fine-tuning element and a harmonic tuning element. A base plate is pivotally supported on the guitar body. Each of saddles is rotatably coupled to one of saddle holders, the position of which can be adjusted in the longitudinal direction of the strings, and corresponds to one of the strings. Each saddle contacts the corresponding string at a predetermined point. Each string holder, which is located in one of the saddles, holds the corresponding string at a part that is below the contact point of the string. The fine-tuning element fine-tunes each string by changing the rotational angle of the corresponding saddle without actually changing the contact point of the corresponding string. The harmonic tuning element adjusts the position of each saddle holder in the longitudinal direction of the strings. A manipulation portion, which is located on the harmonic tuning element, tunes the harmonic of each string at a position above the base plate while the string is held by the associated string holder.

25 Claims, 7 Drawing Sheets

TREMOLO UNIT FOR ELECTRIC GUITAR

BACKGROUND OF THE INVENTION

The present invention relates to a tremolo unit for an electric guitar.

An electric guitar that has a tremolo unit prevents the electric guitar from being off-key by changes in the tension (pitch) of strings while playing the guitar using the tremolo unit. U.S. Patent Publication No. 4,171,661 discloses an electric guitar that has a tremolo unit. According to the guitar of the above publication, each string is locked by a bolt and a pressing member at a saddle of the tremolo unit. A fixing member is also arranged on a nut in the vicinity of a head to fix the strings. This prevents the guitar to be off-key even when using the tremolo unit.

However, when the strings are locked with the nut, tuning of the strings with tuning pegs is difficult. Therefore, a fine-tuning device is provided on the saddle to permit the guitar to be fine-tuned even after the strings are locked with the nut. The tremolo unit also includes harmonic tuning means, which adjusts the position of a contact point of the strings at the saddle portion in the tuning direction.

FIG. 10 illustrates a tremolo unit that has harmonic tuning means. The tremolo unit is mounted on the body 12 of a guitar and includes a base plate 23, which is supported at the upper portion of the body 12 with hinge mechanisms 22 (only one is shown) such that the base plate 23 can be rotated up and down. Saddle holders 35 (only one is shown) are supported by the base plate 23 such that the saddle holders 35 can be moved forward and backward. Each saddle holder 35 corresponds one of the strings 15 (only one is shown) of the guitar. A saddle 37 is supported by each saddle holder 35 with a pin 38 such that the saddle 37 can be rotated up and down.

Each saddle 37 supports a pad 39, which clamps the corresponding string 15. A string fixing bolt 40 is threaded into each saddle 37. Thus, the string fixing bolt 40 presses and clamps the string 15 with the clamp pad 39. Fine-tuning bolts 42 are threaded into the rear end 230 of the base plate 23. When each fixing bolt 40 is moved up and down with the corresponding fine-tuning bolt 42, force is transmitted to the saddle 37 through the pad 39. This rotates the saddle 37 about the corresponding pin 38. Accordingly, the associated string 15 is fine-tuned.

Harmonic tuning bolts 49 are inserted through pin supports 35*e* formed at the rear end of the base plate 23. A threaded hole 61 is formed in the rear end of each saddle holder 35. The distal end of each harmonic tuning bolt 49 is threaded into the corresponding threaded hole 61 to adjust the forward and backward position of the associated saddle holder 35. Accordingly, the harmonic of the associated string 15 is tuned.

However, according to the above mentioned tremolo unit, the harmonic tuning bolts 49, which move the saddle holders 35 forward and backward, are located at a position lower than the top surface of the body 12. Therefore, to rotate any of the harmonic tuning bolts 49, the base plate 23 is rotated counterclockwise about the hinge mechanisms 22 by a certain amount using a tremolo bar (not shown). That is, the harmonic tuning bolt 49 needs to be moved to a position above the body 12 before being rotated. Therefore, the harmonic tuning operation is troublesome.

Furthermore, when the base plate 23 is rotated, the position of each saddle holder 35 is changed by force transmitted through the associated bolt 49. This rotates the saddle 37 and thus changes the pitch of the corresponding string 15.

SUMMARY OF THE INVENTION

The objective of the present invention is to provide a tremolo unit for an electric guitar that permits the harmonic of strings to be easily tuned.

Further objective of the present invention is to provide a tremolo unit for an electric guitar that permits the harmonic of strings to be tuned while keeping the strings in tune.

To achieve the foregoing objective, the present invention provides a tremolo unit for an electric guitar. Various kinds of members are located on the body of the guitar. Strings are supported by the members at predetermined positions along the longitudinal direction. The strings are tuned by fine-tuning means and harmonic tuning means. The tremolo unit includes a plurality of saddle holders, a plurality of saddles, a plurality of string holders, and a manipulation portion. The saddle holders are located on a base plate. The base plate is pivotally supported on the guitar body. The position of each saddle holder can be adjusted in the longitudinal direction of the strings. Each saddle is rotatably coupled to one of the saddle holders and corresponds to one of the strings. Each saddle contacts the corresponding string at a predetermined point. Each string holder is located in one of the saddles. Each string holder holds the corresponding string at a part that is below the contact point of the string. The fine-tuning means fine-tunes each string by changing the rotational angle of the corresponding saddle without actually changing the contact point of the corresponding string. The harmonic tuning means adjusts the position of each saddle holder in the longitudinal direction of the strings. The manipulation portion is located on the harmonic tuning means. The manipulation portion tunes the harmonic of each string at a position above the base plate while the string is held by the associated string holder.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An electric guitar 11 that is provided with a tremolo unit 21 according to a preferred embodiment of the present invention will now be described with reference to FIGS. 1 to 5.

Figure 1:
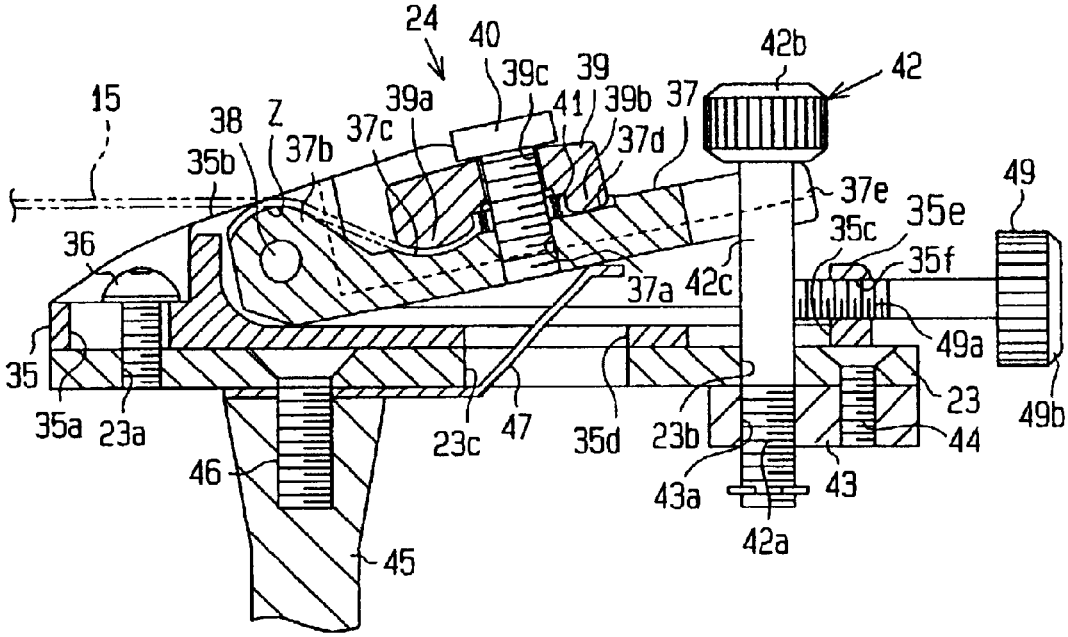
FIG. 1 is a cross-sectional view illustrating a tremolo unit according to a preferred embodiment of the present invention.
Figure 5:
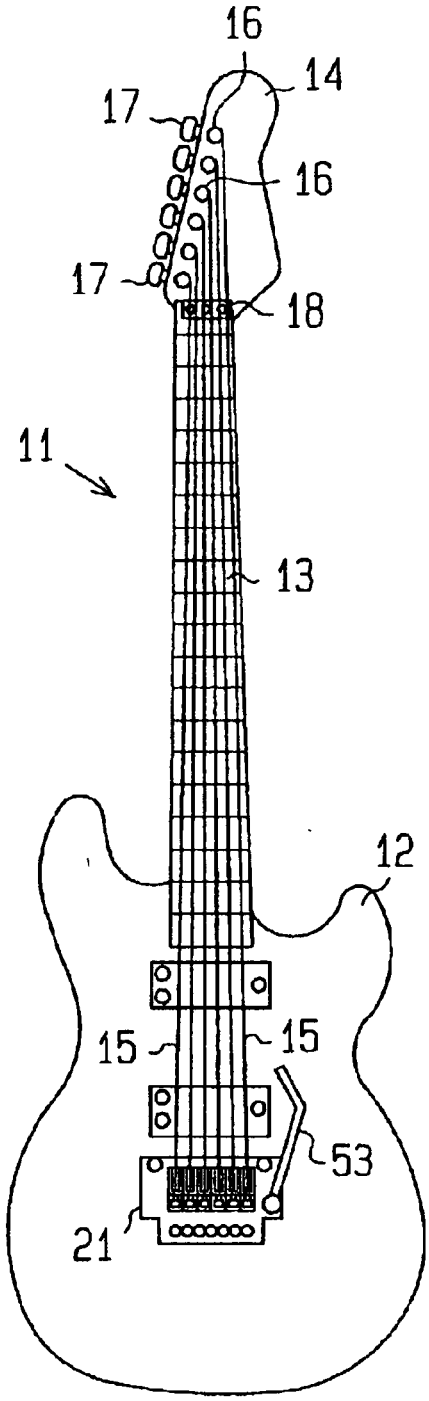
FIG. 5 is a front view illustrating an electric guitar.

FIG. 5 is a view illustrating the entire electric guitar 11 observing from the top surface side. The near side of FIG. 5 along the direction perpendicular to the surface of the sheet of FIG. 5 is referred to as the upper direction of the electric guitar 11 and the upper side of FIG. 1 is referred to as the front side of the electric guitar 11.

The electric guitar 11 includes a solid body 12 and a neck 13, which extends from the body 12. A head 14 is located at the distal end of the neck 13. Six tuning posts 16 are arranged on the head 14 and can be rotated to wind up strings 15. A gear mechanism (not shown) is arranged on the backside of each tuning post 16. Tuning pegs 17, each of which is provided for one of the tuning posts 16, are located on the head 14. Each tuning peg 17 rotates the corresponding tuning post 16 by the gear mechanism. That is, each set of the tuning post 16, the gear mechanism, and the tuning peg 17 tunes the corresponding string 15. A nut 18 is located at the distal end of the neck 13 and the strings 15 contact the nut 18. The strings 15 are pressed by a pressing member from above and tightened to the nut 18 with bolts.

The tremolo unit 21 is located at the center of the body 12 shifted slightly rearward. The six strings 15, which are pressed against the nut 18, are pressed against the tremolo unit 21. The strings 15 are tightly stretched at a predetermined tension and substantially parallel to one another. The body 12 has a pick-up, which detects vibration of the strings and converts the vibration into electric signals. The electric signals generated by the pick-up are transmitted to an amplifier via a cable (not shown) to be amplified and subsequently converted into sound.

The structure of the tremolo unit 21 will now be described with reference to an exploded perspective view shown in FIG. 4.

The tremolo unit 21 includes a base plate 23 and bridge saddles 24. The base plate 23 is rotatably arranged on the body 12 by hinge mechanisms 22. The bridge saddles 24 are arranged on the upper surface of the base plate 23 and supports the strings 15. The tremolo unit 21 includes a tension applying mechanism 25 and a tremolo manipulation mechanism 26. The tension applying mechanism 25 urges the base plate 23 such that the base plate 23 is rotated in a direction to apply tension to the strings 15. The tremolo manipulation mechanism 26 is located on the base plate 23 and rotates the base plate 23 about the hinge mechanisms 22.

The hinge mechanisms 22, the tension applying mechanism 25, and the tremolo manipulation mechanism 26 will now be described.

Each hinge mechanism 22 includes a bracket 28 and a bearing 30. The bracket 28 is secured to the base plate 23 by a stud bolt 31. The bearing 30 is coupled to the distal end of the bracket 28 by a pin 29. A pair of pin supports 27 is formed integrally with the base plate 23 on both left and right side of the base plate 23. Each pin support 27 includes a bore 27*a*. The bearing 30 of each hinge mechanism 22 is fitted into the corresponding bore 27*a*.

The number of the bridge saddles 24 corresponds to the number of the strings 15. Since the bridge saddles 24 are identical, the structure of one of the bridge saddles 24 will be described with reference to FIGS. 1 to 4. As shown in FIG. 1, each bridge saddle 24 includes a saddle holder 35. The saddle holder 35 has a front slot 35*a* at its distal end. Threaded holes 23*a* are formed in the base plate 23. A bolt 36 is inserted downward in the front slot 35*a*. The bolt 36 is then threaded into the corresponding threaded hole 23*a* so that the saddle holder 35 is secured at a predetermined position on the base plate 23. A saddle 37 is mounted on the saddle holder 35, and a saddle support 35*b* is formed integrally with the saddle holder 35. The distal end of the saddle 37 is coupled to the saddle support 35*b* with a pin 38 so that the saddle 37 can be rotated up and down. A clamp pad 39 is supported by the upper surface of the saddle 37. The clamp pad 39 is securely tightened to the saddle 37 with a string fixing bolt 40. A threaded hole 37*a* is formed in the saddle 37. The string fixing bolt 40, which is inserted through the clamp pad 39, is threaded into the threaded hole 37*a* of the saddle 37. A string receiver 37*b*, which is formed at the front end of the saddle 37, contacts the string 15 at a contact point Z.

The clamp pad 39 includes a retainer 39*a*, which retains the corresponding string 15 in cooperation with a receiving surface 37*c* of the saddle 37. A fulcrum 39*b* is provided at the rear portion of the clamp pad 39 and contacts a support surface 37*d* of the saddle 37. A through hole 37*c* through which the string fixing bolt 40 is inserted is formed between the retainer 39*a* and the fulcrum 39*b*. The end of the corresponding string 15, from which the end ring has been removed, is held between the retainer 39*a* of the clamp pad 39 and the receiving surface 37*c* of the saddle 37. A spring 41, which is fitted to the string fixing bolt 40, is arranged between the clamp pad 39 and the saddle 37 for urging the clamp pad 39 upward.

A slot 37*e* is formed at the rear end of the saddle 37. A threaded portion 42*a* of a fine-tuning bolt 42 is inserted downward through the slot 37*e* of the saddle 37. A head 42*b* of the fine-tuning bolt 42 is engaged with the top edge of the slot 37*e* of the saddle 37. A mounting plate 43 is attached to the under surface at the rear end of the base plate 23 with a screw 44. Threaded holes 43*a* are formed in the mounting plate 43. The threaded portion 42*a* of the fine-tuning bolt 42 is threaded into the corresponding threaded hole 43*a*. Guide holes 23*b* are formed in the base plate 23. One of the guide holes 23*b* guides the outer circumferential surface 42*c* of the fine-tuning bolt 42. Through holes 23*c* are also formed in the base plate 23. As shown in FIG. 4, a leaf spring member 47, which has leaf springs, is attached to the lower surface of the base plate 23. Each leaf spring projects upward through one of the through holes 23*c*.

Figure 2:
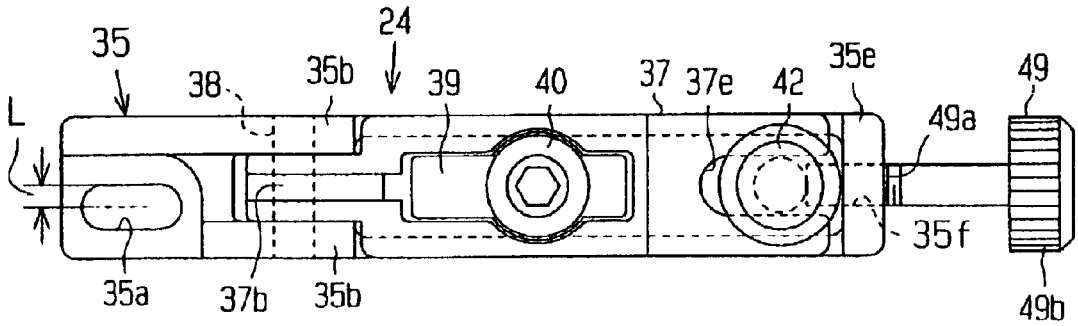
FIG. 2 is a plan view illustrating a bridge saddle and harmonic tuning means.
Figure 3:
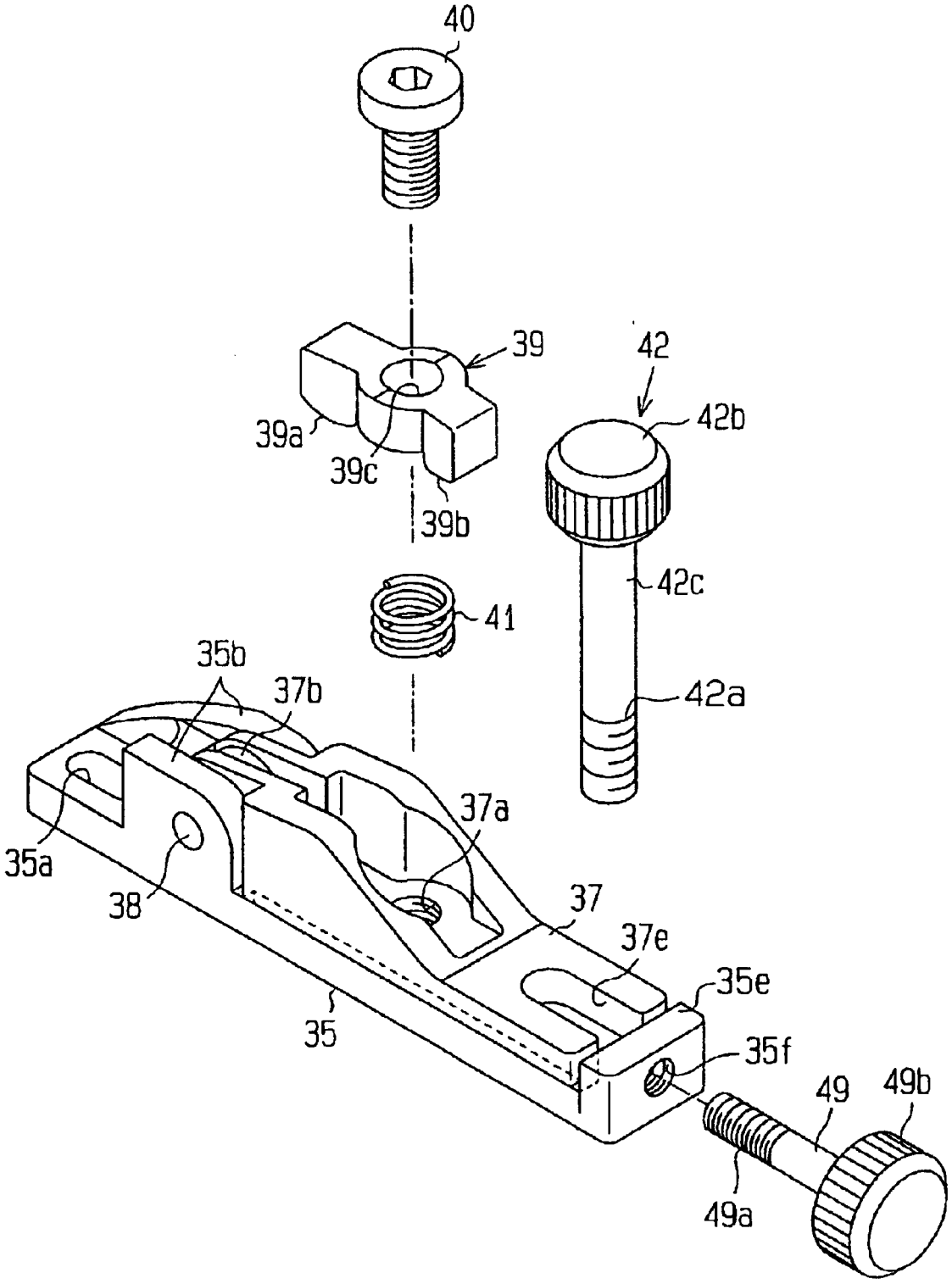
FIG. 3 is an exploded perspective view illustrating the bridge saddle and the harmonic tuning means.

As shown in FIG. 2, the front slot 35*a* of the saddle holder 35 is offset by a predetermined distance in the lateral direction of the saddle holder 35.

A pair of elongate and thick portions extend between pin holders 35*b*. The saddle 37 has a pair of steps respectively formed on both side of the bottom, each of said steps being supported by the thick portion of the saddle holder (see FIGS. 3 and 4).

The tension applying mechanism 25 will now be described.

Figure 4:
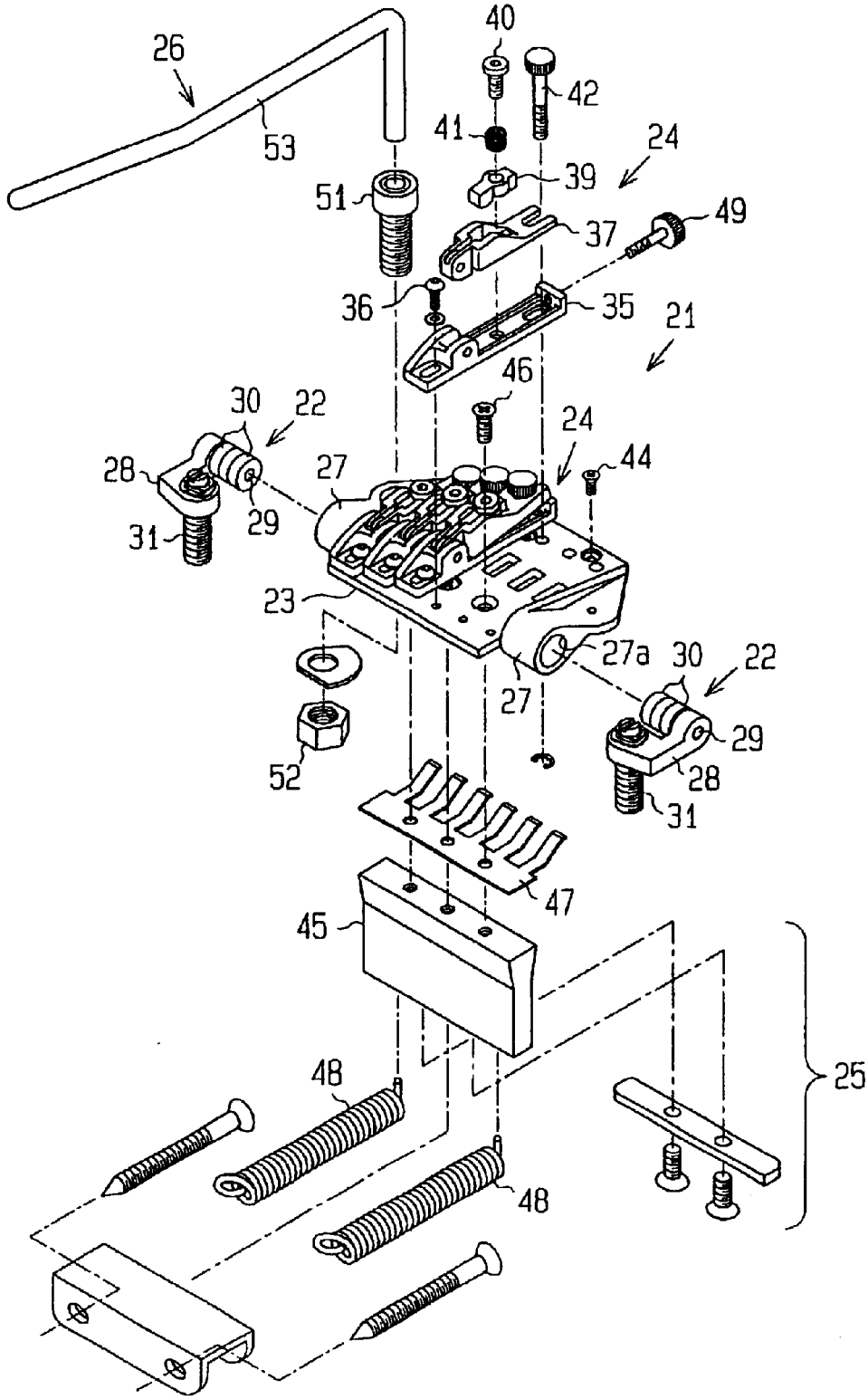
FIG. 4 is an exploded perspective view illustrating the tremolo unit.

As shown in FIG. 4, a tremolo block 45 is secured to the lower surface of the base plate 23 with bolts 46. The leaf spring member 47 is secured between the lower surface of the base plate 23 and the top surface of the tremolo block 45.

As shown in FIG. 1, the distal end of a leaf spring of the leaf spring member 47 is guided through the corresponding through hole 23*c* and pressed against the under surface of the corresponding saddle 37. Therefore, the side edge of the slot 37*e* is pressed against the head 42*b* of the fine-tuning bolt 42. This prevents the noise and improves the operational performance of the fine-tuning bolt 42.

Two springs 48 are attached to the lower surface of the tremolo block 45 at one end. The other end of each spring 48 is attached to a bracket, which is fixed to a predetermined position of the body 12. The springs 48 urges the tremolo block 45 to rotate clockwise as viewed in FIG. 1. This rotates the base plate 23 about the pins 29 in the same direction. Therefore, tension is applied to the strings 15, each of which is arranged on the corresponding bridge saddle 24.

The tremolo manipulation mechanism 26 will now be described with reference to FIG. 4.

The tremolo manipulation mechanism 26 includes a hollow bolt 51 and a nut 52. The hollow bolt 51 is inserted through one side of the base plate 23 downward. The nut 52 is tightened to the lower end of the hollow bolt 51 to secure the hollow bolt 51 to the base plate 23. The distal end of the bent portion of a tremolo bar 53 is detachably inserted into the hollow bolt 51. When the tremolo bar 53 is tilted upward or downward, the base plate 23, the bridge saddles 24, and the tremolo block 45 of the tremolo unit 21 are slightly rotated about the pins 29 against the force of the springs 48.

The main structure of the present invention will now be described.

The rear end of the saddle holder 35 extends toward the rear end of the base plate 23. A rear slot 35*c* is formed in the extended rear portion of the saddle holder 35. The fine-tuning bolt 42 is inserted through the rear slot 35*c*. A middle slot 35*d* is formed at the middle portion of the saddle holder 35. The corresponding leaf spring of the leaf spring member 47 is guided to the lower surface of the saddle 37 through the middle slot 35*d*. A threaded hole 35*f* is formed in the rear upright portion of the saddle holder 35. A threaded portion 49*a* of the harmonic tuning bolt 49, which functions as harmonic tuning means, is threaded into the threaded hole 35*f* of the pin holder 35*e* integrally formed with the rear portion of the saddle holder 35. The distal end of the threaded portion 49*a* of the harmonic tuning bolt 49 contacts the outer circumferential surface 42*c* of the fine-tuning bolt 42. When a manipulation portion 49*b* of the harmonic tuning bolt 49 is rotated, the saddle holder 35 is moved forward or rearward since the distal end of the threaded portion 49*a* of the harmonic tuning bolt 49 is restricted by the outer circumferential surface 42*c*. That is, when the harmonic tuning bolt 49 is threaded toward the outer circumferential surface 42*c*, the saddle holder 35 is pulled rearward and the contact point Z of the corresponding string 15 is moved rearward. On the contrary, when the harmonic tuning bolt 49 is threaded rearward from the outer circumferential surface 42*c*, the saddle holder 35 is pulled forward by the tension of the string 15. Thus, the contact point Z of the string 15 is moved forward.

The operation of the tremolo unit 21 of the electric guitar 11, which is structured as above, will now be described.

To adjust the tension of each string 15, which is connected to one of the bridge saddles 24, without actually changing the position of the contact point Z in the tuning direction, the operator rotates the head 42*b* of the corresponding fine-tuning bolt 42 with the fingers. Turning the head 42*b* moves the top end of the slot 37*e* of the saddle 37 up and down. Thus, the saddle 37 is rotated clockwise or counterclockwise about the pin 38. This adjusts the tension of the string 15.

To tune the harmonic of each string 15 by changing the position of the contact point Z in the tuning direction, the operator unlocks the nut 18 and loosens the corresponding bolt 36. The operator then rotates the harmonic tuning bolt 49 and moves the saddle holder 35 in the tuning direction along the front slot 35*a*. This adjusts the position of the saddle 37 of the bridge saddle 24. Accordingly, the pitch of the string 15 is changed. In this state, the operator rotates the tuning post 16 that corresponds to the string 15 with the associated tuning peg 17. If the harmonic of the string 15 is not appropriate, the operator performs the above described procedure again. If the harmonic of the string 15 is appropriate, the operator tightens the bolt 36 to secure the saddle holder 35 to the base plate 23. The operator then locks the string 15 with the nut 18. Furthermore, the operator rotates the fine-tuning bolt 42 to fine-tune the string 15.

According to the tremolo unit 21 of the present invention, the threaded hole 35*f* is formed in the boss or pin holder 35*e* in the rear upright portion of each saddle holder 35. The harmonic tuning bolt 49 is threaded into the threaded hole 35*f* formed in the boss 35*e* of the saddle holder 35. The distal end of the threaded portion 49*a* of the harmonic tuning bolt 49 contacts the outer circumferential surface of the rod portion 42*c* of the fine-tuning bolt 42. The manipulation portion 49*b* of the harmonic tuning bolt 49 is located above the top surface of the body 12. Therefore, the manipulation portion 49*b* can be rotated to move the saddle holder 35 and the saddle 37 while keeping the string 15 tuned. This permits the harmonic of strings to be easily tuned without rotating the tremolo unit 21.

In addition, the guide holes 23*b* of the base plate 23 guide the fine-tuning bolts 42. Therefore, even when the outer circumferential surface 42*c* of the fine-tuning bolt 42 is pressed by the harmonic tuning bolt 49, the fine-tuning bolt 42 is prevented from becoming loose in the threaded hole 43*a*.

The front slot 35*a* of the saddle holder 35 is offset in the lateral direction. Therefore, the bolt 36 is threaded into the threaded hole 23*a* without interfering with the corresponding string 15.

It should be apparent to those skilled in the art that the present invention may be embodied in many other specific forms without departing from the spirit or scope of the invention. Particularly, it should be understood that the invention may be embodied in the following forms.

Figure 6:
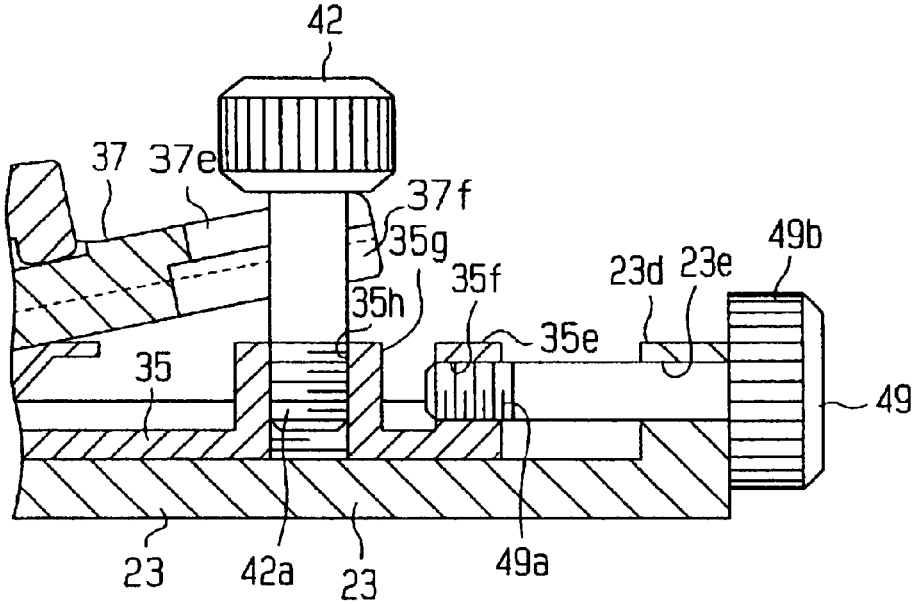
FIG. 6 is a partial cross-sectional view illustrating a further embodiment of the present invention.

According to a further embodiment shown in FIG. 6, bolt support 23*d* extends upward from the rear end of the base plate 23, and through holes 23*e* is formed in the bolt support 23*d*. The harmonic tuning bolts 49 are inserted through the through holes 23*e* and the threaded portion 49*a* of each harmonic tuning bolt 49 is threaded into the threaded hole 35*f* of the corresponding saddle holder 35. In addition, the threaded portion 42*a* of the fine-tuning bolt 42 is threaded into a threaded hole 35*h*, which is formed the boss 35*g* on the top surface of the saddle holder 35. When the harmonic tuning bolt 49 is rotated, the saddle holder 35 is moved forward or backward with the fine-tuning bolt 42 and the saddle 37. A recess 37*f* is formed in the rear of the saddle 37 in association with the slot 37*e* so that the interference between the saddle 37 and boss 35*g* is avoided.

According to the further embodiment shown in FIG. 6, the fine-tuning bolt 42 is not pressed by rotating the harmonic tuning bolt 49. Therefore, the harmonic of strings can easily be tuned while keeping the strings appropriately fine-tuned.

Figure 7:
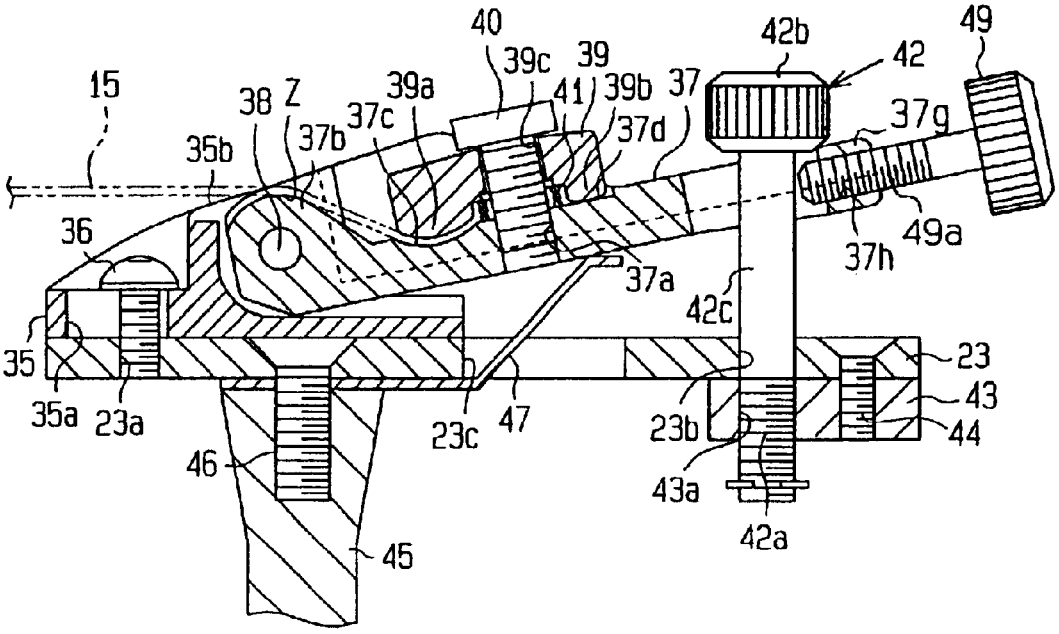
FIG. 7 is a cross-sectional view illustrating a bridge saddle and harmonic tuning means according to a further embodiment of the present invention.

According to a further embodiment shown in FIG. 7, the threaded portion 49*a* of the harmonic tuning bolt 49 is threaded into a threaded hole 37*h* of the pin holder 37*g* formed in the rear end of the saddle 37. The distal end of the threaded portion 49*a* of the harmonic tuning bolt 49 is pressed against the outer circumferential surface of the rod portion 42*c* of the fine-tuning bolt 42.

When the harmonic tuning bolt 49 is rotated toward the fine-tuning bolt 42, the distal end of the threaded portion 49*a* of the harmonic tuning bolt 49 presses the outer circumferential surface of the rod portion 42*c*. Thus, the saddle 37 is moved backward by the reaction force and the tension of the corresponding string 15 increases. As a result, the position of the contact point Z is displaced backward to tune the harmonic of the string 15.

The above described further embodiment provides the same advantages as the illustrated embodiment.

Figure 8:
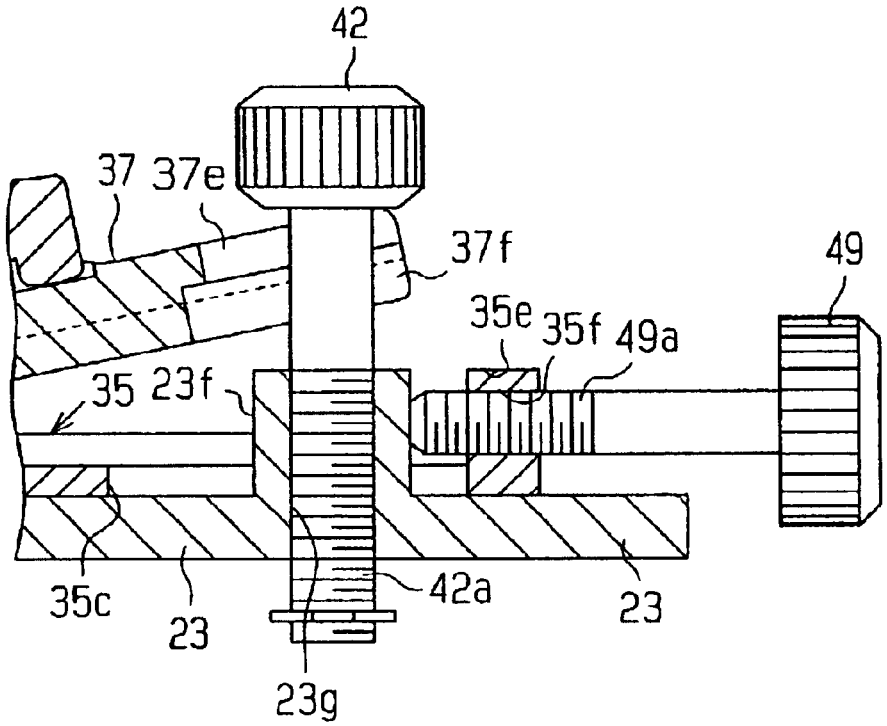
FIG. 8 is a cross-sectional view illustrating a modification with its major parts.
Figure 9:
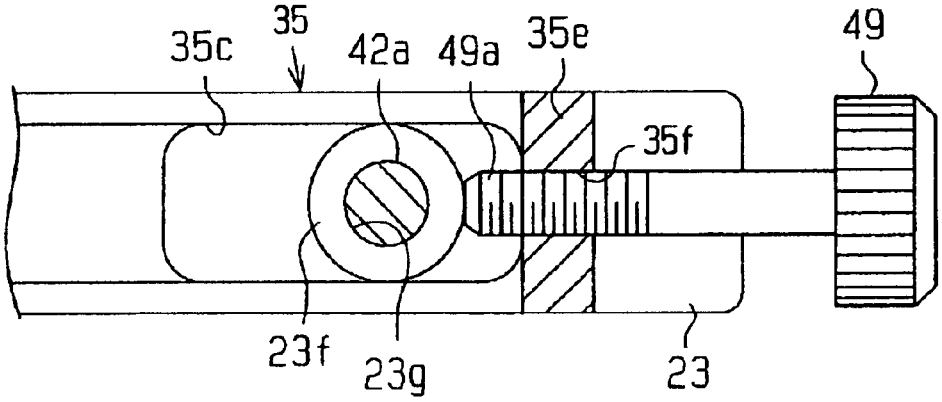
FIG. 9 is a plan view of FIG. 8.
Figure 10:
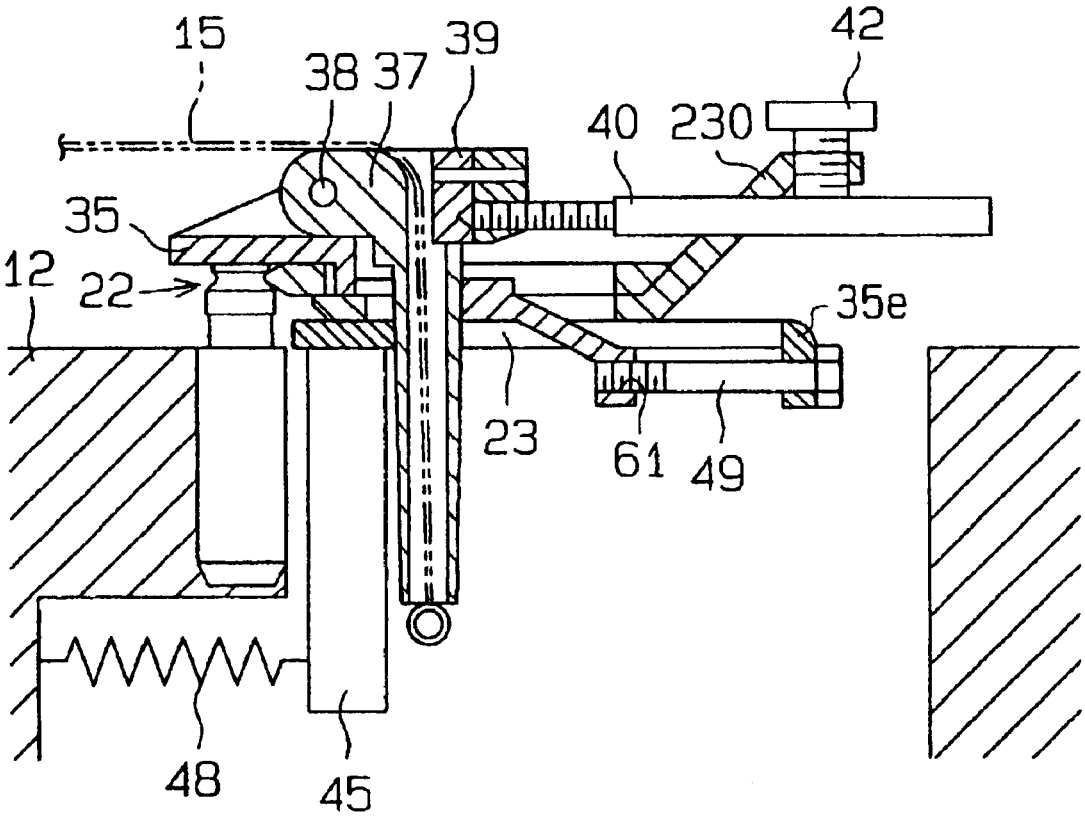
Fig.10 (Prior Art)
FIG. 10 is a cross-sectional view illustrating a prior art tremolo unit.

Another modification is illustrated in FIGS. 8 and 9, in which a cylindrical boss 23*f* is integrally formed on the top of the base plate 23. The threaded portion 42*a* of the fine-tuning bolt 42 in fitted within the threaded hole 23*g* of the boss 23*f*. The threaded portion 49*a* of the harmonic tuning bolt 49 is fitted in the threaded hole 35*f* of the pin holder 35*e* formed in the rear of the saddle holder 35. The tip of the threaded portion 49*a* abuts the outer surface of the boss 23*f*. The recess 37*f* is formed in the rear of the saddle 37 in association with the slot 37*e* so that the saddle 37 and the boss 23*f* do not interfere with each other.

In the above modification, the rotation of the harmonic-tuning bolt 49 urges its tip against the outer surface of the boss 23*f* to adjust the position of the saddle in the tuning direction. The rod portion 42*c* of the fine-tuning bolt 42 does not take a place in the above urging portion. Accordingly, the tuning status of the bolt 42 is stably maintained.

The harmonic tuning means may be located between the base plate or each saddle holder and the fine-tuning means. In this case, the manipulation member such as the fine-tuning bolts, which form the fine-tuning means, are preferably used.

The fine-tuning means may be located between each saddle holder and the corresponding saddle, and the harmonic tuning means may be located between each saddle holder and the base plate.

Therefore, the present examples and embodiments are to be considered as illustrative and not restrictive and the invention is not to be limited to the details given herein, but may be modified within the scope and equivalence of the appended claims.

What is claimed is:

1. A tremolo unit for an electric guitar, wherein support members are located on the body of the guitar, and strings are supported by the support members at predetermined positions along a longitudinal direction, of the guitar body, fine-tuning means and harmonic tuning means for tuning the strings, the tremolo unit comprising:

a base plate, a plurality of saddle holders located on the base plate, the base plate is pivotally supported on the guitar body, and a position of each saddle holder can be adjusted in a longitudinal direction of the strings;

a plurality of saddles, each saddle is rotatably coupled to one of the saddle holders and corresponds to one of the strings, each saddle is shaped to contact the corresponding string at a predetermined point along the length of the base plate regardless of the pivot orientation of the saddle;

a plurality of string holders, each string holder is located in one of the saddles, a part of each string holder holds the corresponding string and the part that holds the string is below the contact point of the string on the saddle;

the saddle is biased vertically and in direct contact with the fine-tuning means and the fine-tuning means is vertically movable to fine-tune each string by changing the rotational angle of the corresponding saddle without actually changing the contact point of the corresponding string on the saddle;

the harmonic tuning means is movable along the longitudinal direction of the strings to adjust the position of each saddle holder on the base plate in the longitudinal direction of the strings; and a manipulation portion located on the harmonic tuning means, the manipulation portion tunes the harmonic of each string at a position above the base plate while the string is held by the associated string holder.

2. The tremolo unit according to claim 1, wherein the harmonic tuning means is located between the base plate or each saddle holder and the fine-tuning means.

3. The tremolo unit according to claim 2, wherein the fine-tuning means comprises a plurality of fine-tuning bolts, each bolt is threaded into one of a plurality of threaded holes formed in the base plate, each fine-tuning bolt having a head is engaged with a rear end of one of the saddles such that the rear end of the saddle is selectively adjusted upward and downward, and wherein the rear end of one of the saddle and the saddle holder has an extended portion, which extends further rearward than the fine-tuning bolt.

4. The tremolo unit according to claim 2, wherein the fine-tuning means comprises a plurality of fine-tuning bolts, each bolt is threaded into one of a plurality of threaded holes formed in the saddle holder, each fine-tuning bolt having a head engaged with the rear end of one of the saddles such that the rear end of the saddle is selectively adjusted upward and downward, and wherein the rear end of the corresponding saddle holder has an extended portion, which extends further rearward than the fine-tuning bolt.

5. The tremolo unit according to claim 2, wherein a threaded hole is formed each saddle holder, the fine-tuning means comprises a plurality of fine-tuning bolts, each bolt is threaded into one of the threaded holes, formed in a boss portion integrally provided with the base plate, each fine-tuning bolt has a head engaged with a rear end of one of the saddles such that the rear end of the saddle is selectively adjusted upward and downward, and a rear end of the corresponding saddle holder has an extended portion, which extends further rearward than the fine-tuning bolt.

6. The tremolo unit according to claim 5, wherein the harmonic tuning means comprises a plurality of harmonic tuning bolts, and a threaded hole formed in the extended portion of each saddle holder, each harmonic tuning bolt is threaded into the threaded hole of one of the saddle holders, and the distal end of each harmonic tuning bolt contacts the outer circumferential surface of the boss portion.

7. The tremolo unit according to claim 3, wherein the harmonic tuning means comprises a plurality of harmonic tuning bolts, a threaded hole formed in the extended portion of each saddle holder, wherein each harmonic tuning bolt is threaded into the threaded hole of one of the saddle holders, each harmonic tuning bolt has a distal end which contacts outer circumferential surface of the corresponding fine-tuning bolt.

8. The tremolo unit according to claim 3, wherein the harmonic tuning means comprises a plurality of harmonic tuning bolts, a threaded hole formed in a rear end portion of each saddle, wherein each harmonic tuning bolt is threaded into the threaded hole of one of the saddles, each harmonic tuning bolt has a distal end that contacts an outer circumferential surface of the corresponding fine-tuning bolt.

9. The tremolo unit according to claim 1, wherein the fine-tuning means is located between each saddle holder and the corresponding saddle.

10. The tremolo unit according to claim 9, wherein the harmonic tuning means is located between each saddle holder and the base plate.

11. The tremolo unit according to claim 10, wherein the harmonic tuning means abuts the fine tuning means via the strings to adjust the positions of the saddle and the saddle holder in a longitudinal direction with respect to the strings.

12. The tremolo unit according to claim 10, wherein the fine-tuning means comprises a plurality of fine-tuning bolts, each of which is threaded into one of a plurality of threaded holes formed in the vicinity of the base plate, wherein the head of each fine-tuning bold is engaged with the rear end of one of the saddles such that the rear end of the saddle is selectively adjusted upward and downward, and wherein the rear end of the corresponding saddle has an extended portion, which extends further rearward than fine-tuning bolt.

13. The tremolo unit according to claim 1, wherein the saddle holder has a distal portion and has a slot in the distal portion, the slot extends widthwise with respect to the holder and a bolt screwed to the base plate through the slot.

14. The tremolo unit according to claim 1, wherein the base plate has a guide slot for guiding the fine tuning bolt.

15. A guitar having a tremolo unit, the tremolo unit comprising:

a base plate, a plurality of saddle holders located on the base plate, wherein the base plate is pivotally supported on the guitar body, and a position of each saddle holder can be adjusted in a longitudinal direction of the strings;

a plurality of saddles, each saddle is rotatably coupled to one of the saddle holders and corresponds to one of the strings, each saddle is shaped to contact the corresponding string at a predetermined point along the length of the base plate regardless of the pivot orientation of the saddle;

a plurality of string holders, each string holder is located in one of the saddles, a part of each string holder holds the corresponding string and the part that hold the string is below the contact point of the string on the saddle;

a fine-tuning means for fine-tuning each string, the saddle being biased vertically and in direct contact with the fine-tuning means, wherein the fine-tuning means is vertically movable to change the rotational angle of the corresponding saddle without actually changing the contact point of the corresponding string on the saddle;

wherein the harmonic tuning means is to adjust the position of each saddle holder in the longitudinal direction of the strings; and a harmonic tuning means movable along the longitudinal direction of the strings to adjust the position of each saddle holder on the base plate in the longitudinal direction of the strings; and a manipulation portion located on the harmonic tuning means, the manipulation portion tunes the harmonic of each string at a position above the base plate while the string is held by the associated string holder.

16. The guitar according to claim 15, wherein the harmonic tuning means is located between the base plate or each saddle holder and the fine-tuning means.

17. The guitar according to claim 16, wherein the fine-tuning means comprises a plurality of fine-tuning bolts, each bolt is threaded into one of a plurality of threaded holes formed in the vicinity of the base plate, each fine-tuning bolt having a head engaged with a rear end of one of the saddles such that the rear end of the saddle is selectively adjusted upward and downward, and wherein the rear end of the corresponding saddle holder has an extended portion, which extends further rearward than the fine-tuning bolt.

18. The guitar according to claim 17, wherein the harmonic tuning means comprises a plurality of harmonic tuning bolts, a threaded hole formed in the extended portion of each saddle holder, wherein each harmonic tuning bolt is threaded into the threaded hole of one of the saddle holders, each harmonic tuning bolt has a distal end which contacts an outer circumferential surface of the corresponding fine-tuning bolt.

19. The guitar according to claim 17, wherein the harmonic tuning means comprises a plurality of harmonic tuning bolts, threaded hole formed in a rear end portion of each saddle, wherein each harmonic tuning bolt is threaded into the threaded hole of one of the saddles, each harmonic tuning bolt has a distal end that contacts an outer circumferential surface of the corresponding fine-tuning bolt.

20. The guitar according to claim 16, wherein a threaded hole is formed in the vicinity of each saddle holder, the fine-tuning means comprises a plurality of fine-tuning bolts, each bolt is threaded into one of the threaded holes, each fine-tuning bolt has a head engaged with a rear end of one of the saddles such that the rear end of the saddle is selectively adjusted upward and downward, and a rear end of the corresponding saddle holder has an extended portion, which extends further rearward than the fine-tuning bolt.

21. The guitar according to claim 20, wherein the harmonic tuning means comprises a plurality of harmonic tuning bolts, a threaded hole in the extended portion of each saddle holder, each harmonic tuning bolt is threaded into the threaded hole of one of the saddle holders, a support on the top surface at the rear end of the base plate, and the head of each harmonic tuning bolt is engaged with the support.

22. The guitar according to claim 15, wherein the fine-tuning means is located between each saddle holder and the corresponding saddle.

23. The guitar according to claim 22, wherein the harmonic tuning means is located between each saddle holder and the base plate.

24. A tremolo unit for an electric guitar, wherein members are located on the body of the guitar, and strings are supported by the support members at predetermined positions along a longitudinal direction of the guitar body, fine-tuning means and harmonic tuning means for tuning the strings, the tremolo unit comprising:

a base plate, a plurality of saddle holders located on the base plate, the base plate is pivotally supported on the guitar body, and a position of each saddle holder can be adjusted in a longitudinal direction of the strings;

a plurality of saddles, each saddle is rotatably coupled to one of the saddle holders and corresponds to one of the strings, each saddle is shaped to contact the corresponding string at a predetermined point along the length of the base plate regardless of the pivot orientation of the saddle;

a plurality of string holders, each string holder is located in one of the saddles, a part of each string holder holds the corresponding string and the part that holds the string is below the contact point of the string on the saddle;

the fine-tuning means fine-tunes each string by changing the rotational angle of the corresponding saddle without actually changing the contact point of the corresponding string on the saddle;

the harmonic tuning means adjusts the position of each saddle holder on the base plate in the longitudinal direction of the strings; and a manipulation portion located on the harmonic tuning means, the manipulation portion tunes the harmonic of each string at a position above the base plate while the string is held by the associated string holder; and wherein the fine-tuning means is located between each saddle holder and the corresponding saddle.

25. A guitar having a tremolo unit, the tremolo unit comprising:

a base plate, a plurality of saddle holders located on the base plate, wherein the base plate is pivotally supported on the guitar body, and a position of each saddle holder can be adjusted in a longitudinal direction of the strings;

a plurality of saddles, each saddle is rotatably coupled to one of the saddle holders and corresponds to one of the strings, each saddle is shaped to contact the corresponding string at a predetermined point along the length of the base plate regardless of the pivot orientation of the saddle;

a plurality of string holders, each string holder is located in one of the saddles, a part of each string holder holds the corresponding string and the part that holds the string is below the contact point of the string on the saddle;

fine-tuning means for fine-tuning each string to change the rotational angle of the corresponding saddle without actually changing the contact point of the corresponding string on the saddle;

a harmonic tuning means adjusts the position of each saddle holder on the base plate in the longitudinal direction of the strings; and a manipulation portion located on the harmonic tuning means, the manipulation portion tunes the harmonic of each string at a position above the base plate while the string is held by the associated string holder; and wherein the fine-tuning means is located between each saddle holder and the corresponding saddle.

* * * * *